US010712687B2

(12) United States Patent
Suenaga

(10) Patent No.: US 10,712,687 B2
(45) Date of Patent: Jul. 14, 2020

(54) DEVELOPER CONTAINER

(71) Applicant: Konica Minolta, Inc., Tokyo (JP)

(72) Inventor: Takenori Suenaga, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/595,730

(22) Filed: Oct. 8, 2019

(65) Prior Publication Data

US 2020/0133163 A1 Apr. 30, 2020

(30) Foreign Application Priority Data

Oct. 30, 2018 (JP) ..... 2018-203951

(51) Int. Cl.
*G03G 15/08* (2006.01)

(52) U.S. Cl.
CPC ..... *G03G 15/0886* (2013.01); *G03G 15/0872* (2013.01)

(58) Field of Classification Search
CPC ..... G03G 15/0867; G03G 15/0872; G03G 15/0877; G03G 15/0886
USPC ..... 399/262
See application file for complete search history.

(56) References Cited

U.S. PATENT DOCUMENTS 8,155,568 B2 * 4/2012 Naito et al. ..... G03G 15/087 399/262
9,411,266 B2 * 8/2016 Shinohara et al. ..... G03G 15/0872

FOREIGN PATENT DOCUMENTS

JP 2015045815 A 3/2015

* cited by examiner

*Primary Examiner* — William J Royer
(74) *Attorney, Agent, or Firm* — Cantor Colburn LLP

(57) ABSTRACT

A developer container includes a container main body that stores a developer, has an outlet for discharging the developer to a downstream side in a conveyance direction in which the developer is conveyed, has a sidewall having a circular cross-section perpendicular to the conveyance direction, and has a first ridge that continuously or intermittently continues to the downstream side in a helical form in a certain winding direction and is formed on an inner surface of the sidewall, and a limiter disposed at a downstream end that is an end on the downstream side of the container main body, to secure a space between the limiter and the sidewall, the space extending to an upstream side of the outlet in the conveyance direction and extending from the upstream side to the outlet.

8 Claims, 10 Drawing Sheets

DEVELOPER CONTAINER

CROSS REFERENCE TO PRIOR APPLICATION

The present invention claims priority under 35 U.S.C. § 119 to Japanese patent Application No. 2018-203951, filed on Oct. 30, 2018, the entire content of which is incorporated herein by reference.

BACKGROUND

Technological Field

The present invention relates to a developer container to be used in an electrophotographic image forming apparatus.

Description of the Related Art

An electrophotographic image forming apparatus forms a toner image on a photosensitive member, an intermediate transfer belt, or the like, and transfers the formed toner image onto a paper sheet with a transfer unit. The image forming apparatus then fixes the transferred toner image to the paper sheet with a fixing unit.

Developer containers that supply a developer to a developing unit are also mounted in such an image forming apparatus. Each developer container stores a developer containing a toner and a carrier that are blended with each other. In many cases, a developer container is used, with its container main body being laid laterally in an image forming apparatus. A developer container is sometimes called a "toner bottle".

A helical ridge for conveying the stored developer is formed on the inner peripheral surface of the container main body. When the container main body is made to rotate, the stored developer is conveyed to a discharge port at the front end of the container main body, and discharged to the developing unit.

Where the amount of developer stored in the container main body is larger, the amount of developer to be conveyed to the discharge port is more likely to be larger than the amount of developer to be discharged from the discharge port. Therefore, the density of the developer is higher in the space near the discharge port, and the fluidity of the developer is likely to become lower. As a result, it becomes difficult for the developer to be discharged from the discharge port.

To counter that, a developer container disclosed in JP 2015-45815 A has been suggested. This developer container includes a container main body, a discharger, and a limiter. The limiter is disposed in a space formed by the container main body and the discharger, to divide the space into a container space in which developer is stored in the container main body, and a discharge-side space in which the developer to be discharged from a discharge port is stored. Further, the limiter forms a passage hole through which the developer is to pass, and limits the amount of the developer to be conveyed from the container space to the discharge-side space.

Meanwhile, with the developer container disclosed in JP 2015-45815 A, if the developer has fluidity within a certain range, it is possible to prevent the developer from being aggregated in the vicinity of the discharge port, and eliminate the difficulty for the developer to be discharged from the discharge port.

However, in the case of a developer in which toners that differ in fluidity are blended with each other, it might become difficult for the developer to be discharged from the discharge port.

SUMMARY

In view of the above problems, the present invention aims to reduce the amount of developer that has a certain fluidity and is to be aggregated in the vicinity of a discharge port at the time of discharge from a developer container to a smaller amount than those in conventional cases.

To achieve the abovementioned object, according to an aspect of the present invention, a developer container reflecting one aspect of the present invention comprises a container main body that stores a developer, has an outlet for discharging the developer to a downstream side in a conveyance direction in which the developer is conveyed, has a sidewall having a circular cross-section perpendicular to the conveyance direction, and has a first ridge that continuously or intermittently continues to the downstream side in a helical form in a certain winding direction and is formed on an inner surface of the sidewall; and a limiter disposed at a downstream end that is an end on the downstream side of the container main body, to secure a space between the limiter and the sidewall, the space extending to an upstream side of the outlet in the conveyance direction and extending from the upstream side to the outlet, wherein one of the limiter and the sidewall has a second ridge for reducing an area of a cross-section of the space perpendicular to the conveyance direction at a first position to a smaller area than an area of a cross-section of the space perpendicular to the conveyance direction at a second position.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
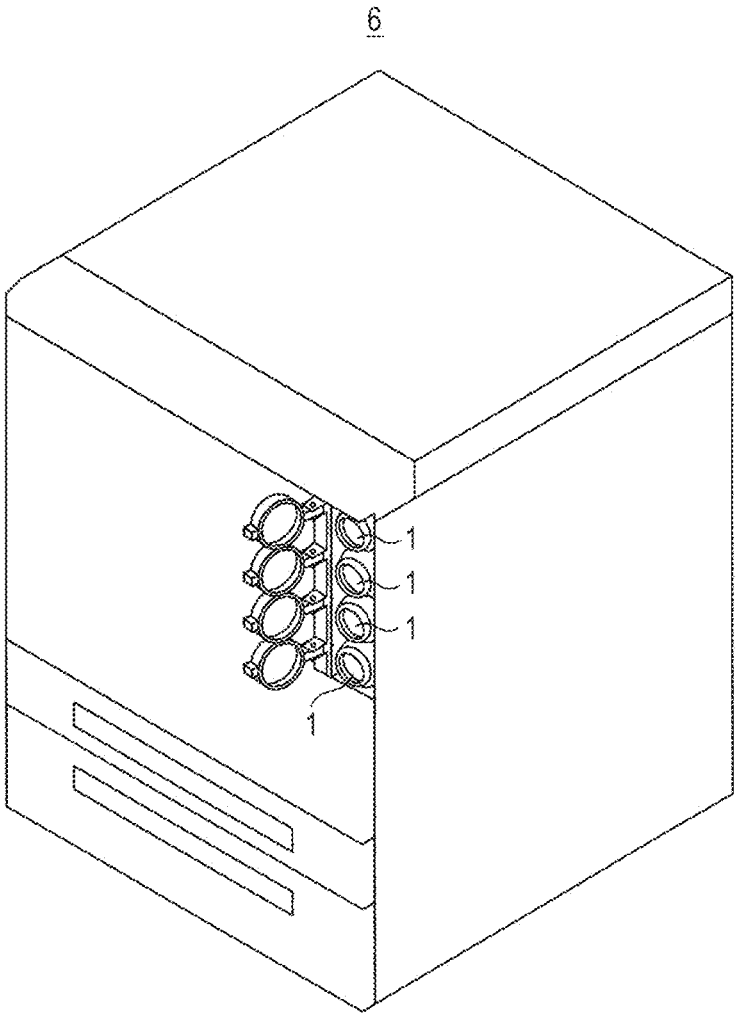
FIG. 1 is a view showing an example of the external appearance of an image forming apparatus.
Figure 2:
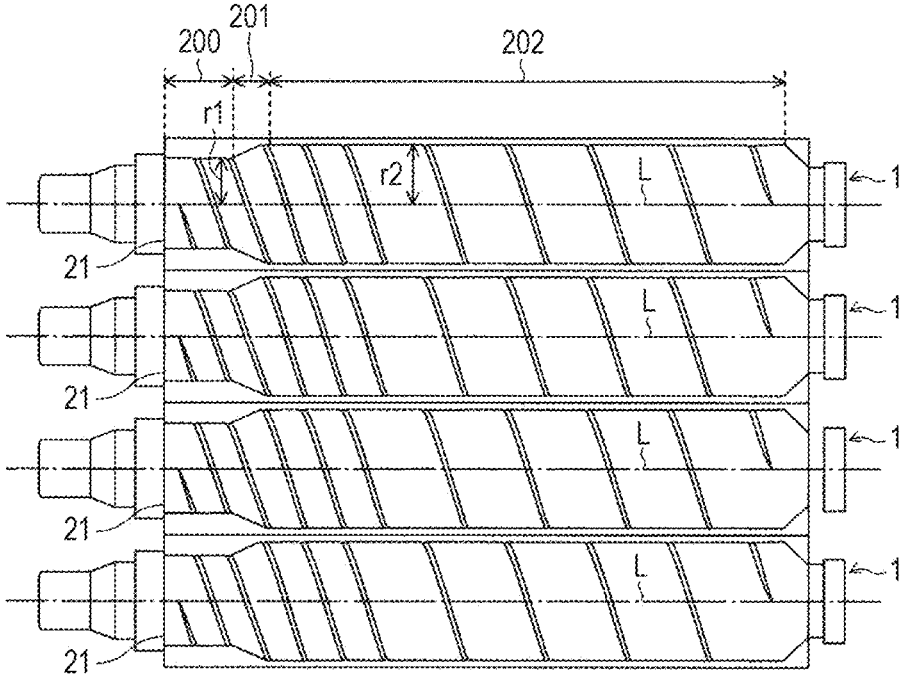
FIG. 2 is a view showing an example of a state in which developer containers are set in the image forming apparatus.

FIG. 1 is a view showing an example of the external appearance of an image forming apparatus 6. FIG. 2 is a view showing an example of a state in which developer containers 1 are set in the image forming apparatus 6.

The image forming apparatus 6 shown in FIG. 1 is an electrophotographic image forming apparatus such as a multifunction machine, a copying machine, a printer, or a facsimile terminal, and prints an image onto a paper sheet using toners of the four colors: cyan, magenta, yellow, and black. In the image forming apparatus 6, developer containers 1 for the four respective colors are mounted, and developers of the four respective colors are supplied from the respective developer containers 1. A developer mainly contains a toner and a carrier in a blended state.

As shown in FIG. 2, the developer containers 1 in a laid state are mounted in the image forming apparatus 6 so that the longitudinal direction of each developer container 1 is substantially horizontal. Each developer container 1 then supplies the developer to the image forming apparatus 6 while rotating about a rotation axis L.

The configurations of all of the developer containers 1 of cyan, magenta, yellow, and black are the same. Therefore, the configuration, the functions, and the like of the developer container 1 of one specific color will be described below as an example.

[Configuration of a Developer Container 1]

Figure 3:
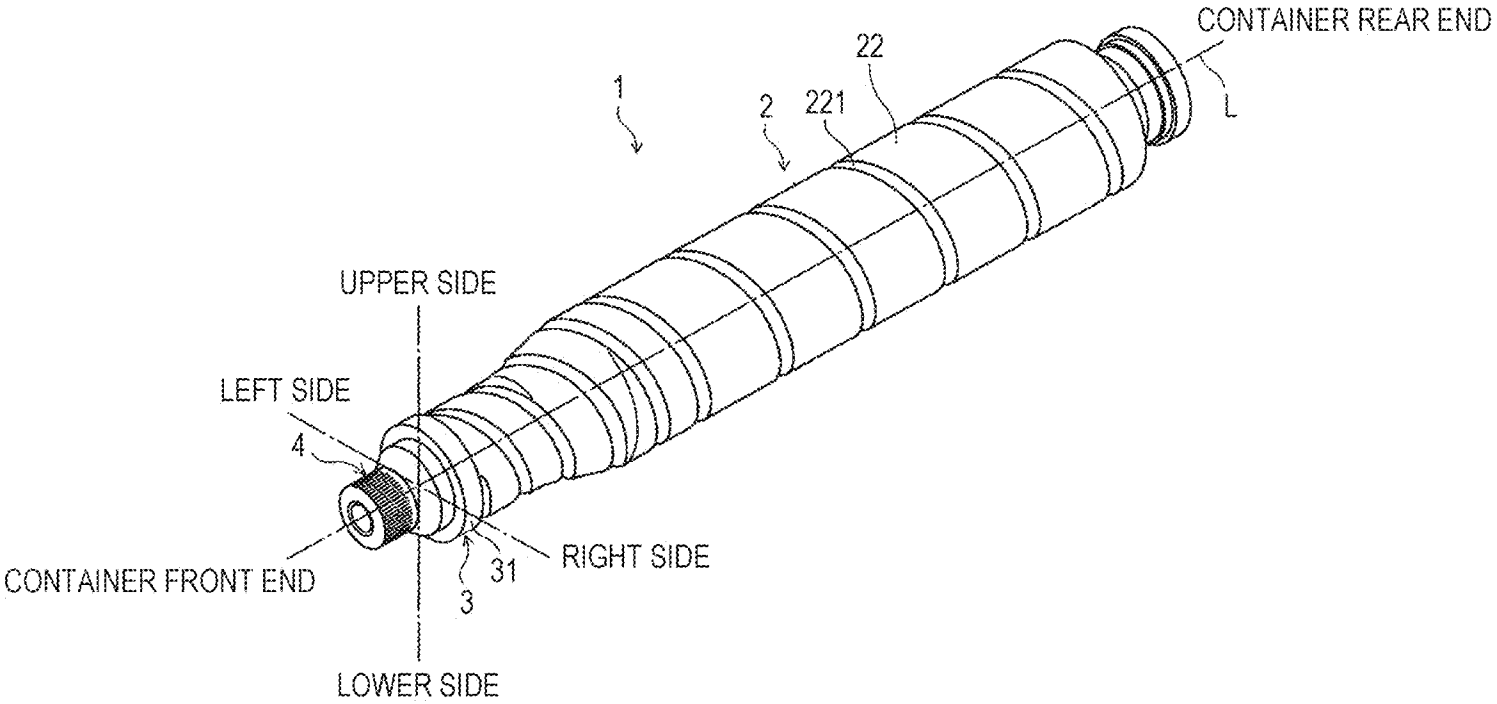
FIG. 3 is a perspective view of an example of the external appearance of a developer container.
Figure 4:
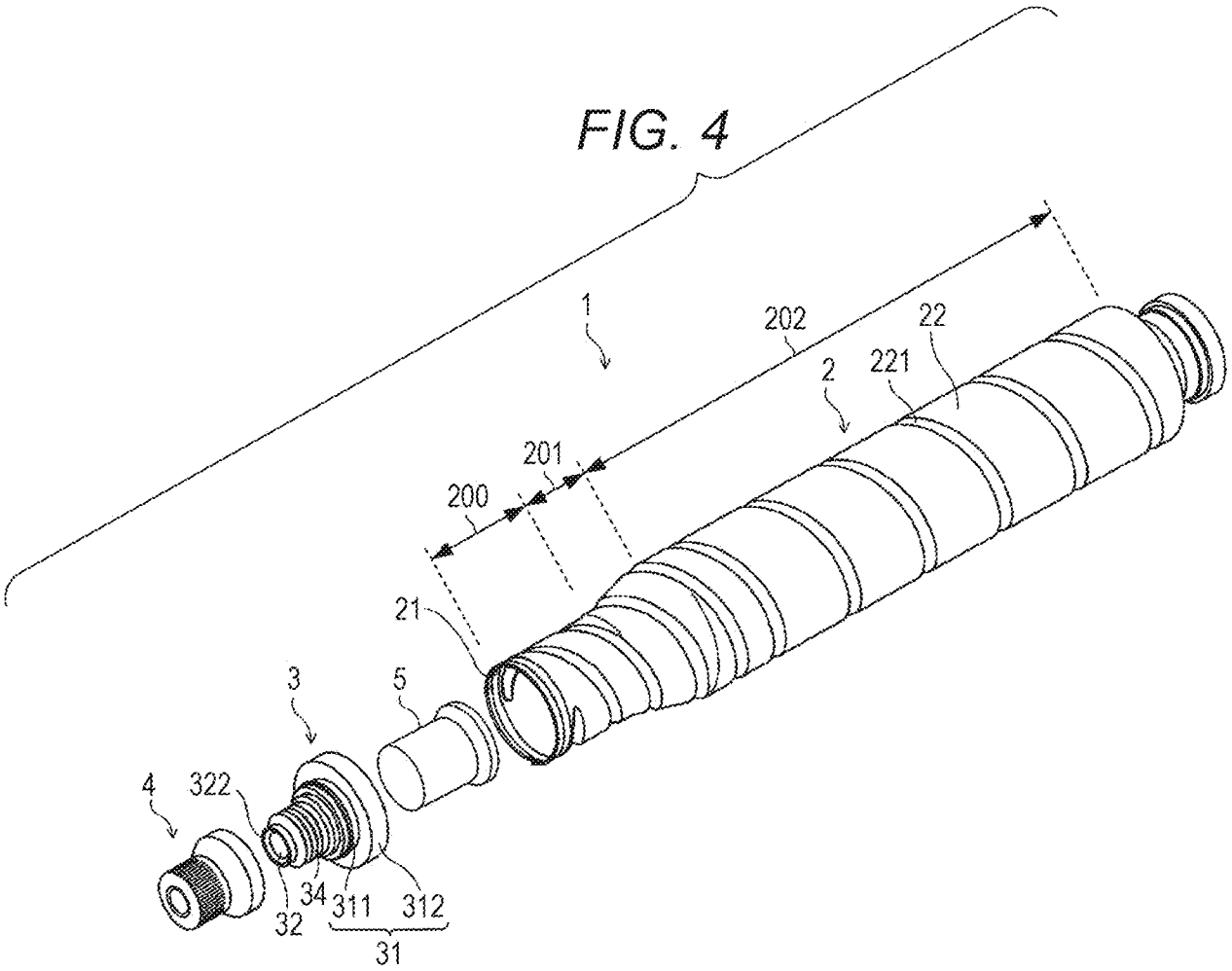
FIG. 4 is an exploded view of an example of a developer container.

FIG. 3 is a perspective view of an example of the external appearance of a developer container 1. FIG. 4 is an exploded view of an example of a developer container 1.

As shown in FIG. 3 or FIG. 4, a developer container 1 includes a container main body 2, a discharger 3, a cap 4, and a limiter 5. Hereinafter, the end of the developer container 1 to which the cap 4 is attached will be referred to as the "container front end", and the opposite end from the container front end will be referred to as the "container rear end".

The discharger 3 is attached to the container main body 2 on the side of the container front end. The cap 4 is attached to the discharger 3 on the side of the container front end. The limiter 5 is disposed between the container main body 2 and the discharger 3.

[Container Main Body 2]

The container main body 2 stores a developer. The container main body 2 is formed in a substantially cylindrical shape that is hollow inside, and an opening 21 is formed on the side of the container front end.

As shown in FIG. 2, the radius of a cross-section of the container main body 2 taken perpendicularly to the longitudinal direction maintains a certain radius r1 in a portion extending a certain distance from the opening 21 toward the container rear end (this portion will be hereinafter referred to as the "front portion 200"). The radius of the cross-section gradually becomes greater in a portion further extending a certain distance (this portion will be hereinafter referred to as the "tapered portion 201"). The radius of the cross-section of the remaining portion extending to the container rear end maintains a certain radius r2 (this portion will be hereinafter referred to as the "rear portion 202").

Further, on a sidewall 22 of the container main body 2, a ridge 221 that protrudes toward the inside of the container main body 2 is formed continuously or intermittently in a helical form. The ridge 221 is formed from the end on the side of the container rear end to the end on the side of the container front end. Note that the helical direction (the winding direction) of the ridge 221 is set in accordance with the direction of rotation of the container main body 2.

As the container main body 2 rotates about the rotation axis L, the ridge 221 conveys the developer stored in the container main body 2 to the opening 21. However, the discharger 3 and the limiter 5 are disposed in the opening 21, and, as will be described later, the amount of the developer passing through the opening 21 is limited by the discharger 3 and the limiter 5.

[Discharger 3]

Figure 5:
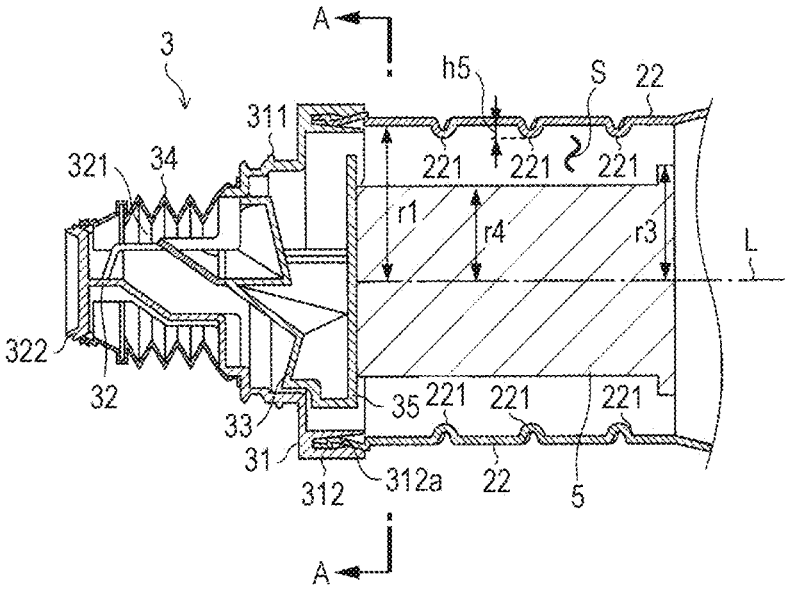
FIG. 5 is a cross-sectional view of the front end and the vicinity of the front end of a container main body, a discharger, and a limiter, taken along a line that is parallel to the rotation axis L and is perpendicular to a horizontal plane.
Figure 6:
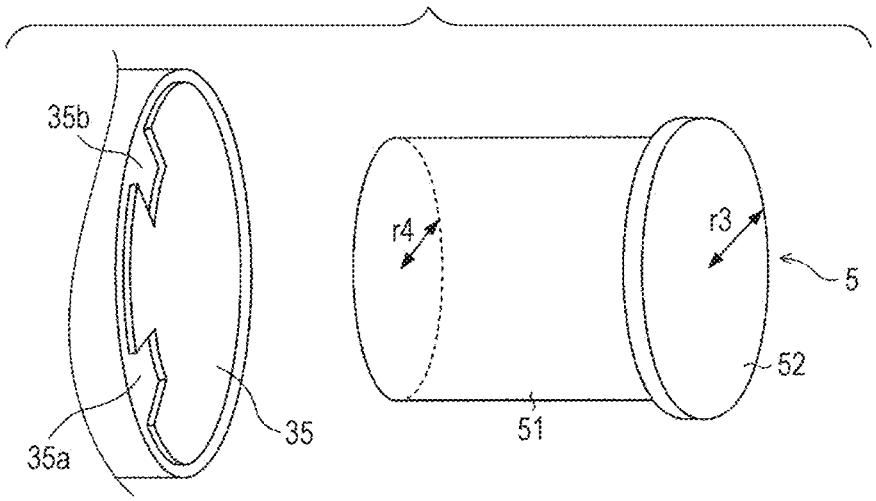
FIG. 6 is a view showing a state in which the limiter and a joining portion are separated.
Figure 7:
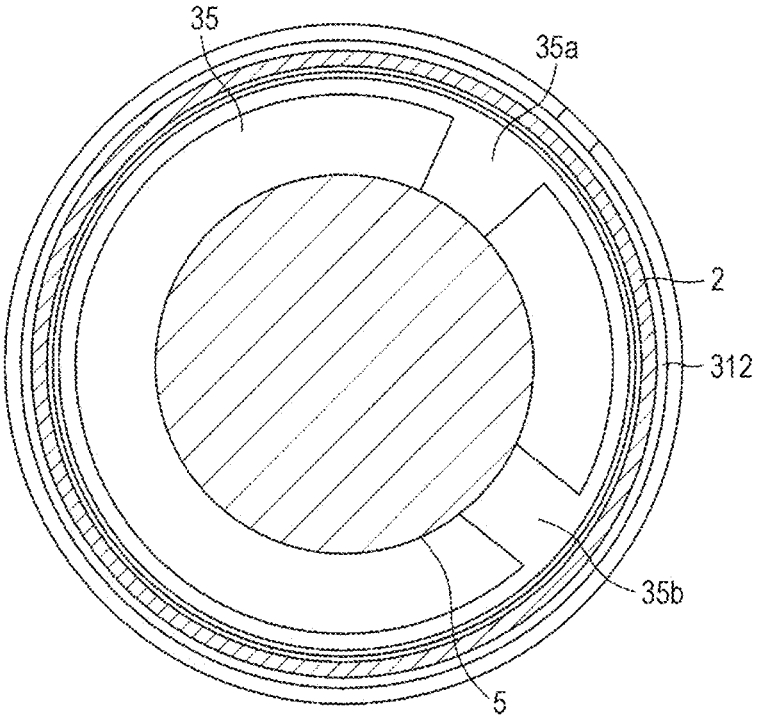
FIG. 7 is a cross-sectional view taken along the line A-A defined in FIG. 5.

FIG. 5 is a cross-sectional view of the front end and the vicinity of the front end of the container main body 2, the discharger 3, and the limiter 5, taken along a line that is parallel to the rotation axis L and is perpendicular to a horizontal plane. FIG. 6 is a view showing a state in which the limiter 5 and a joining portion 35 are separated. FIG. 7 is a cross-sectional view taken along the line A-A defined in FIG. 5.

The discharger 3 is attached to the container main body 2, to close the opening 21 of the container main body 2. As shown in FIG. 5, the discharger 3 includes a mouth portion 31, a discharging portion 32, a conveying blade 33, a covering portion 34, and a joining portion 35.

The mouth portion 31 has such a shape that two cylinders whose radius is shorter on the side of the container front end than on the side of the container rear end are overlapped so that the respective centers coincide with each other. The mouth portion 31 has a screw portion 311 on a side surface of the cylinder on the side of the container front end, and has an engaging portion 312 on a side surface of the cylinder on the side of the container rear end.

The screw portion 311 is screwed with a screw groove formed on the inner side of the cap 4. On the inner side of the engaging portion 312, an engaging groove 312*a* extending from the rear end of the mouth portion 31 toward the container front end is formed. The front end of the container main body 2 is inserted into the engaging groove 312*a*. The engaging portion 312 then engages with the front end of the container main body 2. With this structure, the discharger 3 rotates together with the container main body 2. Further, the discharging portion 32 is provided at the front end of the mouth portion 31.

The discharging portion 32 includes a discharge port 321 through which the developer is to be discharged out of the container, and a hooking portion 322. The hooking portion 322 is formed in a disk-like shape. The front end of the covering portion 34 described later is temporarily hooked by the hooking portion 322. The conveying blade 33 is disposed at the rear end of the discharging portion 32.

The conveying blade 33 is attached to the discharging portion 32, and is disposed in the cylindrical hole of the mouth portion 31. The front end of the conveying blade 33 continues to the discharge port 321 of the discharging portion 32, and the rear end of the conveying blade 33 is located close to the inner wall of the mouth portion 31. When the container main body 2 and the mouth portion 31 rotate, the conveying blade 33 scrapes up the developer sent from the container main body 2, and conveys the developer to the discharge port 321 of the discharging portion 32. Thus, even when the amount of the developer decreases, the developer can be efficiently discharged from the discharge port 321.

The covering portion 34 is formed as a substantially cylindrical bellows-like member. The front end of the covering portion 34 is hooked and held by the hooking portion 322 of the discharging portion 32. The rear end of the covering portion 34 is fixed to the front end of the mouth portion 31.

As shown in FIG. 6, the joining portion 35 is integrally formed with the conveying blade 33, and is disposed on the rear end side of the mouth portion 31.

The joining portion 35 is formed in a disk-like shape, and has cutout portions 35*a* and 35*b* that are located at certain positions on the periphery and penetrate in parallel with the rotation axis L. The diameter of the joining portion 35 is set at a smaller value than the diameter of the mouth portion 31 on the side of the container rear end.

Before the developer container 1 is mounted in the image forming apparatus 6, the covering portion 34 covers the discharge port 321 of the discharging portion 32. In this structure, the developer can be prevented from leaking out of the discharge port 321 before the developer container 1 is mounted in the image forming apparatus 6. Further, when the developer container 1 is mounted in the image forming apparatus 6, the front end of the covering portion 34 is detached from the hooking portion 322, and is contracted toward the container rear end. As a result, the discharge port 321 of the discharging portion 32 is exposed.

[Cap 4]

The cap 4 is formed in a hollow, truncated cone-like shape as shown in FIG. 4. The screw groove to be screwed with the screw portion 311 of the mouth portion 31 is formed in the inner wall of the cap 4. Before the developer container 1 is mounted in the image forming apparatus 6, the cap 4 is attached to the discharger 3 so as to be covered by the covering portion 34 (see FIG. 4), as shown in FIG. 3. When the developer container 1 is mounted in the image forming apparatus 6, the cap 4 is removed from the discharger 3.

[Limiter 5]

As shown in FIG. 6, the limiter 5 is formed with a guide portion 51, a limiter plate 52, and the like.

The guide portion 51 is a member having a cylindrical shape. As will be described later, the developer is guided to the cutout portions 35*a* and 35*b* by the side surface of the guide portion 51 and the ridge 221 of the container main body 2. The guide portion 51 is fixed to the joining portion 35 so that the rotation axis L passes through the center of the bottom surface of the guide portion 51. Therefore, when the container main body 2 rotates, the limiter 5 rotates together with the container main body 2 and the discharger 3.

The limiter plate 52 is a disk-shaped member, and is formed integrally with the guide portion 51 on the rear end side of the guide portion 51. As will be described later, the amount of the developer to be guided to the cutout portions 35*a* and 35*b* is limited. The axis of the limiter plate 52 coincides with the rotation axis L.

As shown in FIG. 5 or FIG. 6, the radius r3 of the limiter plate 52 is greater than the radius r4 of the bottom surface of the guide portion 51. However, the radius r3 is smaller than the value obtained by subtracting the height h5 of the ridge 221 from the radius of a cross-section, which is the radius r1, of the front portion 200. That is, the radius r3 is expressed as $r3<(r1-h5)$.

A space S continuing from the tapered portion 201 is formed between the limiter 5 and the sidewall 22. The area of a cross-section of the space S perpendicular to the rotation axis L of the space S is not constant, and narrows at the position of the limiter plate 52.

[Developer Discharging Operation]

Figure 8:
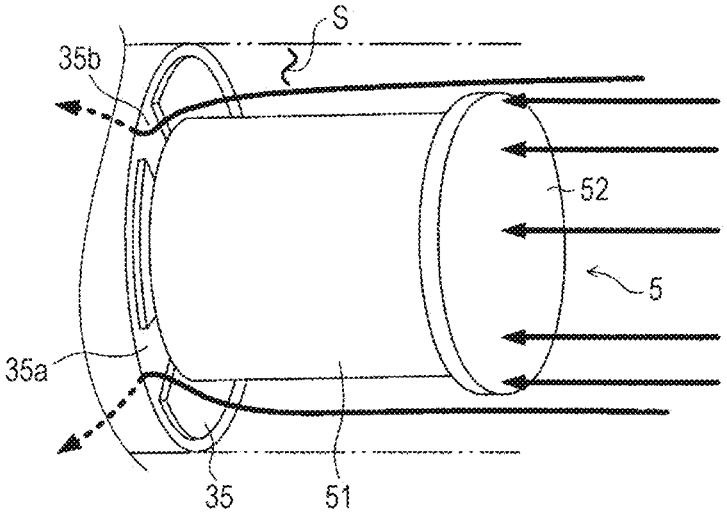
FIG. 8 is a diagram showing an example of the flow of the developer in the limiter and the vicinity thereof.

FIG. 8 is a diagram showing an example of the flow of the developer in the limiter 5 and the vicinity thereof.

Next, a developer discharging operation in the developer container 1 is described, with reference to FIG. 8 and others.

The container main body 2 is filled with the developer in advance, and the limiter 5 is attached to the discharger 3 beforehand. The cap 4 is then removed, and the developer container 1 is mounted in the image forming apparatus 6. At this stage, the front end of the covering portion 34 is disengaged from the hooking portion 322 in conjunction with the mounting, and contracts toward the rear end, so that the discharge port 321 of the discharging portion 32 is exposed.

When the container main body 2 rotates about the rotation axis L, the discharger 3 rotates together with the container main body 2. The developer is then conveyed from the container main body 2 to the discharger 3 little by little by the ridge 221 as described below.

As shown in FIG. 5, in the vicinity of the opening 21 of the container main body 2, the joining portion 35 and the limiter 5 are disposed. Accordingly, as shown in FIG. 8, part of the developer comes into contact with the limiter plate 52 of the limiter 5. Thus, the amount of the developer to be conveyed to the downstream side (the container front end side) of the limiter plate 52 is limited.

Further, since $r3>r4$, which means the radius of the limiter plate 52 is greater than that of the bottom surface of the guide portion 51, part of the limiter plate 52 protrudes from the guide portion 51. With this part, it is possible to reduce the density of the developer in the volume of the space S to a lower density than those in conventional cases.

The developer having passed through the portion between the limiter plate 52 and the sidewall 22 of the container main body 2 is guided along the side surface of the guide portion 51 by the ridge 221 to reach the joining portion 35, and flow into the cutout portion 35*a* or 35*b*. The developer is then conveyed to the discharge port 321 by the conveying blade 33, and is discharged from the discharge port 321.

According to this embodiment, the amount of developer that has a certain fluidity and is to be aggregated in the vicinity of the discharge port at the time of discharge from the developer container 1 can be reduced to a smaller amount than those in conventional cases. Thus, the occurrence of a decrease caused in the density of an image due to defective discharge of the developer or formation of aggregates can be prevented more reliably than in conventional cases.

[Modifications]

Figure 9A:
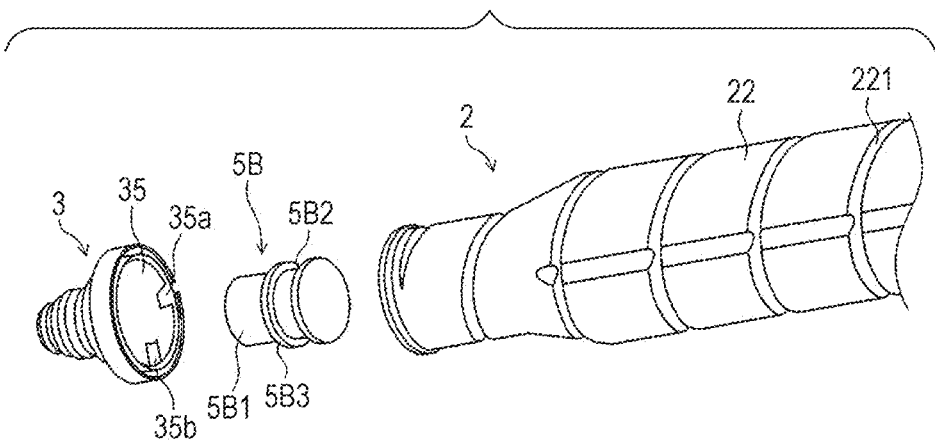
FIG. 9A and FIG. 9B are views of a first modification of the developer container.
Figure 9B:
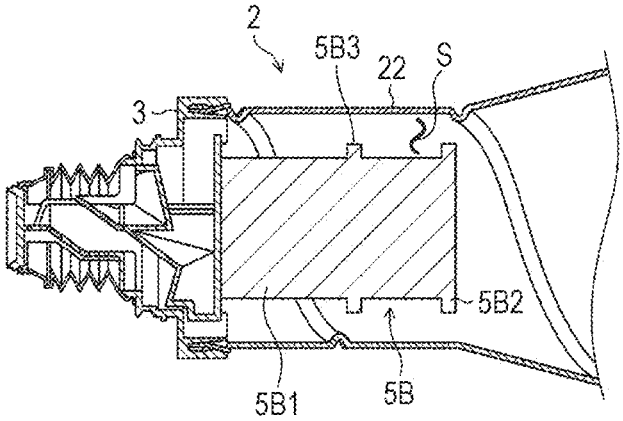

FIG. 9A and FIG. 9B are views of a first modification of the developer container 1. FIG. 9A is a perspective view of a limiter 5B. FIG. 9B is a cross-sectional view of the front portion 200 and the vicinity thereof, taken along the rotation axis L.

In this embodiment, the limiter 5 is disposed in the joining portion 35, as shown in FIG. 4 through FIG. 8. The limiter 5 is formed with the guide portion 51 and the limiter plate 52 disposed on the container rear end side of the guide portion 51. However, the component described below may be used in place of the limiter 5.

For example, a limiter 5B formed with a cylindrical guide portion 5B1, a limiter plate 5B2 disposed on the container rear end side of the guide portion 5B1, and a ring-shaped limiter plate 5B3 disposed in the middle of the side surface of the guide portion 5B1 as shown in FIG. 9A may be used in place of the limiter 5, as shown in FIG. 9B. The limiter plate 5B3 is not in contact with the sidewall 22 of the container main body 2.

With the limiter plate 5B3, it is possible to further reduce the density of the developer in the vicinities of the cutout portions 35*a* and 35*b*.

Figure 10A:
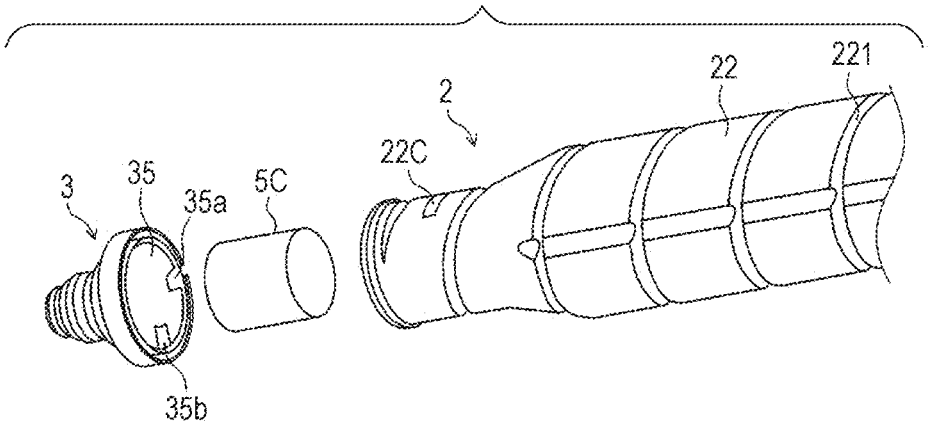
FIG. 10A through FIG. 10D are views of a second modification of the developer container.
Figure 10B:
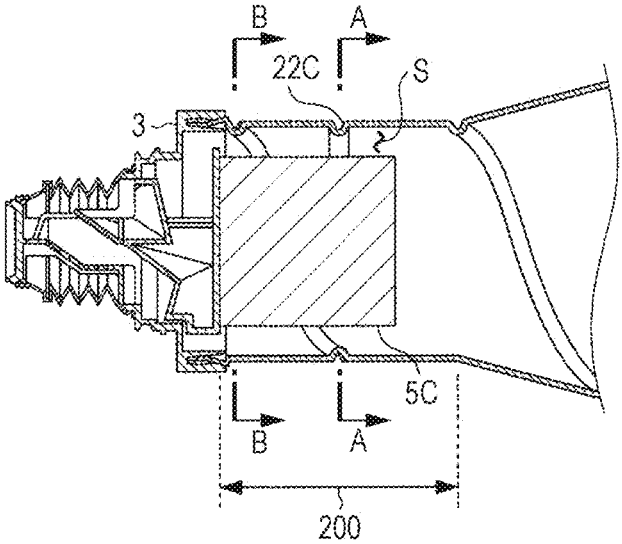
Figure 10C:
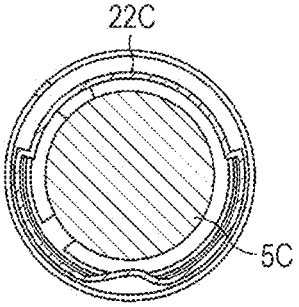
Figure 10D:
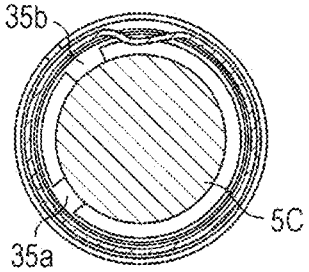

FIG. 10A through FIG. 10D are views of a second modification of the developer container 1. FIG. 10A is a perspective view of the container main body 2, a limiter 5C, and the discharger 3 in a case where the developer container 1 is disassembled. FIG. 10B is a cross-sectional view of the front portion 200 and the vicinity thereof, taken along the rotation axis L. FIG. 10C is a cross-sectional view of the front portion 200, taken along line A-A defined in FIG. 10B. FIG. 10D is a cross-sectional view of the front portion 200, taken along line B-B defined in FIG. 10B.

A limiter 5C having a cylindrical shape as shown in FIG. 10A may be used in place of the limiter 5, as shown in FIG. 10B. In this case, a ridge 22C protruding toward the inside of the container main body 2 is preferably formed at the front portion 200 of the container main body 2. The ridge 22C is not formed in a helical shape like the ridge 221, but is formed so that the angle with the rotation axis L is 90 degrees.

In this modification, instead of the limiter plate 52, 5B2, or 5B3, the ridge 22C limits the amount of the developer to be conveyed to the joining portion 35.

Figure 11A:
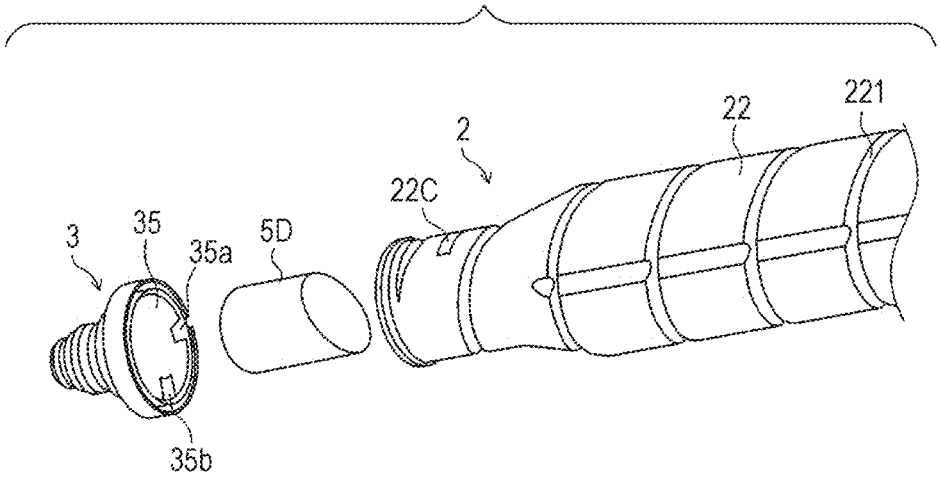
FIG. 11A and FIG. 11B are views of a third modification of the developer container.
Figure 11B:
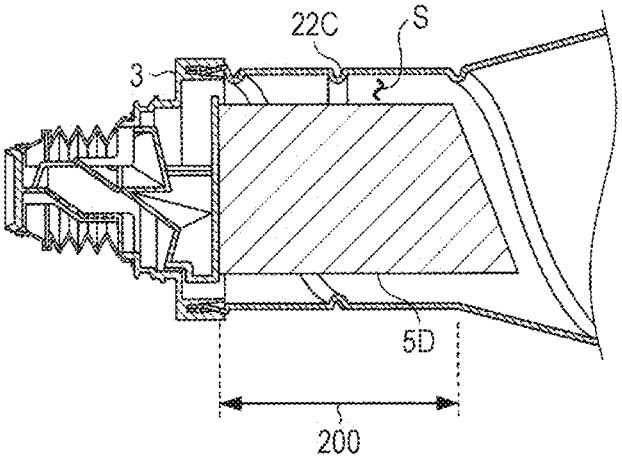

FIG. 11A and FIG. 11B are views of a third modification of the developer container 1. FIG. 11A is a perspective view of the container main body 2, a limiter 5D, and the discharger 3 in a case where the developer container 1 is disassembled. FIG. 11B is a cross-sectional view of the front portion 200 and the vicinity thereof, taken along the rotation axis L.

A limiter 5D having a cylindrical shape with an obliquely-cut end as shown in FIG. 11A may be used in place of the limiter 5, as shown in FIG. 11B. In this case, a ridge 22C protruding toward the inside of the container main body 2 is preferably formed at the front portion 200 of the container main body 2, as in the case where the limiter 5C is used.

Figure 12A:
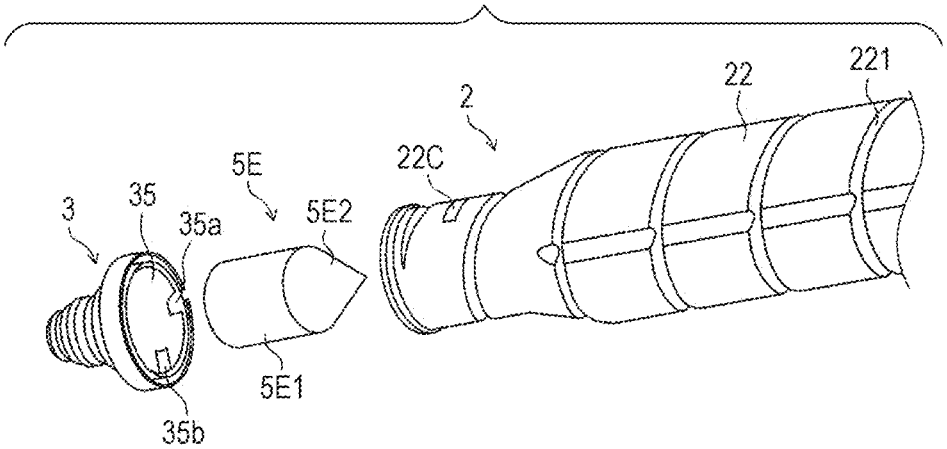
FIG. 12A and FIG. 12B are views of a fourth modification of the developer container.
Figure 12B:
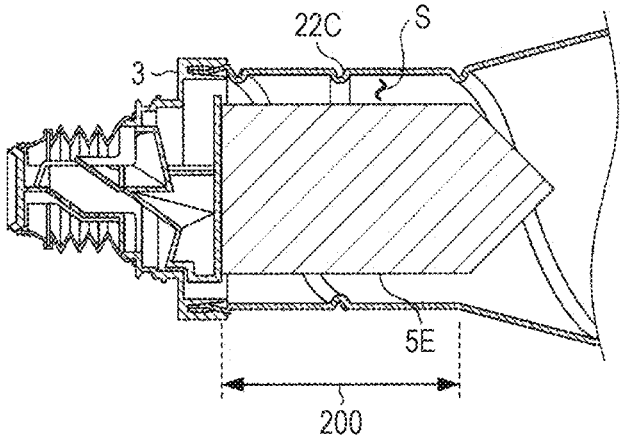
Figure 13:
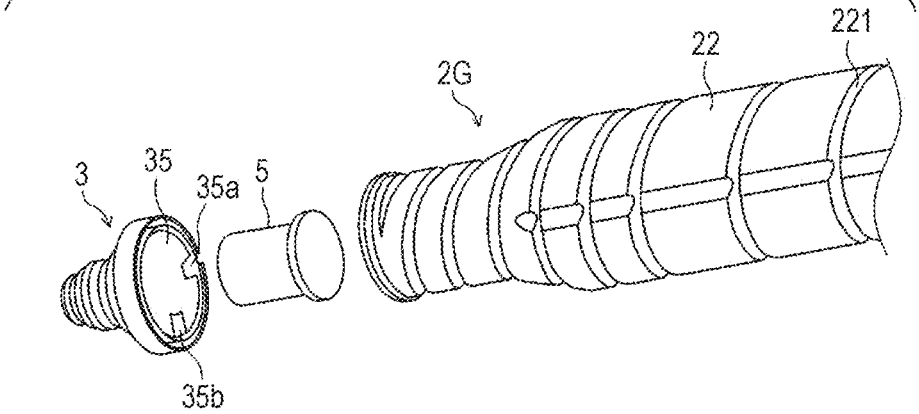
FIG. 13 is a view of a fifth modification of the developer container.

FIG. 12A and FIG. 12B are views of a fourth modification of the developer container 1. FIG. 13 is a view of a fifth modification of the developer container 1. FIG. 12A is a perspective view of the container main body 2, a limiter 5E, and the discharger 3 in a case where the developer container 1 is disassembled. FIG. 12B is a cross-sectional view of the front portion 200 and the vicinity thereof, taken along the rotation axis L.

A limiter 5E having a circular cylinder 5E1 and a circular cone 5E2 formed on the container rear end side of the circular cylinder 5E1 as shown in FIG. 12A may be used in place of the limiter 5, as shown in FIG. 11B. In this case, a ridge 22C protruding toward the inside of the container main body 2 is preferably formed at the front portion 200 of the container main body 2, as in the case where the limiter 5C is used. The radii of the respective bottom surfaces of the circular cylinder 5E1 and the circular cone 5E2 are equal. Alternatively, the circular cone 5E2 may have the longer radius.

Further, as shown in FIG. 13, a container main body 2G that has a plurality of (two, for example) helical ridges in the front portion 200 and the tapered portion 201 may be used in place of the container main body 2.

Although the two cutout portions 35*a* and 35*b* are provided as the outlets of the developer in this embodiment, only one cutout portion may be formed, or three or more cutout portions may be formed.

Furthermore, the configuration of the entire developer container 1 or each component thereof may be modified as appropriate within the scope of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developer container comprising:

a container main body that stores a developer, has an outlet for discharging the developer to a downstream side in a conveyance direction in which the developer is conveyed, has a sidewall having a circular cross-section perpendicular to the conveyance direction, and has a first ridge that continuously or intermittently continues to the downstream side in a helical form in a certain winding direction and is formed on an inner surface of the sidewall; and a limiter disposed at a downstream end that is an end on the downstream side of the container main body, to secure a space between the limiter and the sidewall, the space extending to an upstream side of the outlet in the conveyance direction and extending from the upstream side to the outlet, wherein one of the limiter and the sidewall has a second ridge for reducing an area of a cross-section of the space perpendicular to the conveyance direction at a first position to a smaller area than an area of a cross-section of the space perpendicular to the conveyance direction at a second position.

2. The developer container according to claim 1, wherein the limiter has a circular cylinder at the downstream end, and has one or a plurality of the second ridges on a side surface of the circular cylinder.

3. The developer container according to claim 1, wherein the second ridge is formed on the inner surface of the sidewall on the downstream side of an end on the upstream side of the limiter.

4. The developer container according to claim 3, wherein the limiter is a circular cylinder.

5. The developer container according to claim 3, wherein the limiter is a circular cylinder that has an obliquely-cut end and has a bottom surface at the downstream end.

6. The developer container according to claim 3, wherein the limiter has a circular cylinder and a circular cone whose radii are equal to each other, and one end surface of the circular cylinder is disposed at the downstream end, and a bottom surface of the circular cone is disposed on the other end surface of the circular cylinder.

7. The developer container according to claim 1, wherein the container main body has two of the first ridges.

8. The developer container according to claim 1, wherein the outlet is disposed at the downstream end.

* * * * *